US007736408B2

(12) United States Patent
Böck et al.

(10) Patent No.: US 7,736,408 B2
(45) Date of Patent: Jun. 15, 2010

(54) REMOVABLE DUST COLLECTING RECEPTACLE

(75) Inventors: Armin Böck, Grossbardorf (DE); Albert Kleinhenz, Burgwallbach (DE); Michael Krammer, Burgwallbach (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 794 days.

(21) Appl. No.: 10/554,124

(22) PCT Filed: Apr. 22, 2004

(86) PCT No.: PCT/EP2004/004291

§ 371 (c)(1),
(2), (4) Date: Feb. 12, 2007

(87) PCT Pub. No.: WO2004/093631

PCT Pub. Date: Nov. 4, 2004

(65) Prior Publication Data

US 2007/0130895 A1 Jun. 14, 2007

(30) Foreign Application Priority Data

Apr. 24, 2003 (DE) ..... 203 06 405

(51) Int. Cl.
*B01D 45/12* (2006.01)
*B01D 50/00* (2006.01)

(52) U.S. Cl. ..... 55/337; 55/429; 55/459.1; 55/DIG. 3

(58) Field of Classification Search ..... 55/337, 55/429, 459.1, DIG. 3
See application file for complete search history.

(56) References Cited

U.S. PATENT DOCUMENTS

| | | | | |
|---|---|---|---|---|
| 5,779,745 | A | 7/1998 | Kilström | |
| 6,428,589 | B1 | 8/2002 | Bair et al. | |
| 6,532,620 | B2 | 3/2003 | Oh et al. | |
| 7,207,083 | B2 * | 4/2007 | Hayashi et al. | 15/347 |
| 2002/0088078 | A1 | 7/2002 | Oh et al. | |

FOREIGN PATENT DOCUMENTS

| | | |
|---|---|---|
| DE | 100 21 594 A 1 | 11/2001 |
| WO | WO 02/067752 A1 | 9/2002 |

* cited by examiner

*Primary Examiner*—Robert A Hopkins
(74) *Attorney, Agent, or Firm*—James E. Howard; Andre Pallapies

(57) ABSTRACT

A removable dust collecting receptacle for use in a dust compartment of a vacuum cleaner, comprising a dust separator, which functions according to the centrifugal force principle and which has a dust collecting compartment for collecting a dust fraction separated out of the air by the dust separator. The suction power of the vacuum cleaner is maintained over a long period of time by virtue of the fact that the dust collecting receptacle has at least one second dust collecting compartment for collecting at least one second dust fraction separated out by a separating device. The fine dust collected in the second dust collecting compartment via the separating device can no longer reach the filter, and the filter surface is prevented or largely prevented from being clogged by fine dust.

35 Claims, 4 Drawing Sheets

REMOVABLE DUST COLLECTING RECEPTACLE

The invention relates to a removable dust collecting receptacle for use in a dust compartment of a vacuum cleaner according to the preamble of claim 1.

A generic dust collecting receptacle is known from DE 100 21 594 A1. The dust collecting receptacle there comprises a centrifugal force separator, an immersion pipe and a dust collecting compartment. The dust collecting receptacle is constructed so that it can be used in a conventional vacuum cleaner. Further, the dust collecting receptacle has an air inlet opening, and a filter unit detachably attached at the side of the housing. Constructed on one side wall of the centrifugal-force separator is a separating opening which extends partly over its circumference. Dust is separated into the dust collecting compartment via the separating opening. The air flow reaches the centre of the centrifugal force separator according to the cyclone principle and is passed via the immersion pipe to the filter unit where it passes outside through the filter unit. The filter is necessary because the dust retention capacity of the centrifugal force separator is lower than that of a conventional dust filter bag so that residual dust located in the air flow must be retained by the filter.

A disadvantage here is that the fine dust retained by the filter remains adhered to the surface of the filter and as a consequence, the filter becomes clogged by the adhering fine dust as the operating time increases. Thus, the suction power of the vacuum cleaner can deteriorate even if the user regularly empties the dust collecting receptacle. Since the fine dust retained by the filter is not removed when emptying the dust collecting compartment, the air flow through the dust collecting receptacle remains low since the fine dust deposited by the filter blocks the filter surface and causes a high pressure drop.

It is the object of the invention to improve a generic dust collecting receptacle such that the suction power of the vacuum cleaner is maintained over a long period of time.

This object is solved according to the invention by the fact that the dust collecting receptacle has at least one second dust collecting compartment for collecting at least one second dust fraction separated by a separating device.

Since the dust collecting receptacle has at least one further dust collecting compartment, in particular fine dust can be deposited separately from the coarse dust in a separate dust collecting compartment. The fine dust is separated by means of a separating device and collected in at least one second dust collecting compartment. The collected fine dust can no longer reach the filter and clogging of the filter surface by fine dust is prevented or largely avoided.

In particular, substantially more fine dust than can be deposited on the filter surface can be collected in this at least one additional dust collecting compartment. Since two separate dust collecting compartments are provided for coarse dust and fine dust, a higher quantity of dust can be collected. As a result, the dust collecting receptacles need only be emptied at greater time intervals. In addition, since less fine dust is deposited on the filter surface, the operating time of the dust collecting receptacle is increased considerably. The filter surfaces of the dust collecting receptacle need to be cleaned less frequently than with usual dust collecting receptacles.

The separating device can be constructed such that the second dust fraction is either separated from the dust-laden air or from the first dust fraction. For separation of the second dust fraction from the dust-laden air, the separating device is connected fluid-dynamically to the dust separator. As a result, the second dust fraction which is preferably formed from fine dust can be separated from the dust-laden air at the same time as the first dust fraction separated by the dust separator which preferably forms the coarse dust. This process-technological parallel switching of separating device and dust separator relieves the pressure on the dust separator since the second dust fraction or the fine dust is already separated from the dust-laden air and the dust separator only needs to separate the first dust fraction or the coarse dust from the air.

Alternatively, for separating the second dust fraction, especially the fine dust from the first dust fraction, the separating device can be positioned downstream from the dust separator. In such an embodiment both the fine dust and the coarse dust are separated from the air by the dust separator. The separation of the second dust fraction or the fine dust from the first dust fraction by the separating device then takes place downstream from the dust separator. Such a process-technological series switching of separating device and dust separator makes it possible to arrange the separating device at a spatial distance from the dust separator. This has the advantage that the dust collecting receptacle can be configured more freely, i.e., the spatial position of dust separator and separating device inside the dust collecting receptacle can be selected independently of the process-technological requirements.

In an advantageous embodiment of the invention, the dust collecting receptacle has a second outlet for removing the at least second dust fraction separated by the separating device into the at least second dust collecting compartment. Since the dust collecting receptacle has a second outlet, the second dust fraction can be passed into the second dust collecting compartment separately from the first dust fraction. It is thereby possible for coarse dust and fine dust to be reliably collected separately in two different dust collecting compartments. The second outlet preferably forms a fine dust outlet.

The separating device can be arranged between the dust separator and the first dust collecting compartment or the second dust collecting compartment. As a result of this arrangement, short flow paths are obtained between the dust separator and the dust collecting compartments. This has the advantage that expensive flow channels and pipe sections can be dispensed with.

The separating device is preferably embodied as a separator surface arranged in an opening of a wall, especially a side wall of the dust separator. As a result of this construction of the separating device as a separator surface, a very flat design of separating device is achieved. This has the advantage that the respective dust collecting compartment can directly adjoin the dust separator, where dust collecting compartment and dust separator preferably have a common side wall section. This has the advantage that the flow path between dust separator and dust collecting compartment is reduced to a minimum and the separating device constructed as a separator surface is located in an opening of a wall between dust separator and dust collecting compartment. A particularly compact structure of the dust collecting receptacle is thereby achieved.

The dust separator can have a cylindrical side wall and the separator surface can be arranged in the side wall downstream of the inlet opening and upstream of the first outlet in the direction of flow of the dust-laden air. By arranging the separator surface, preferably for separating the fine dust, between the inlet opening for dust-laden air and the first outlet, preferably for the coarse dust, the second dust fraction or the fine dust is already separated before reaching the first outlet for the first dust fraction or the coarse dust. This pre-separation relieves the pressure on the dust separator and improves the separation of the first dust fraction or the coarse dust from the dust-laden air.

The inlet opening for dust-laden air can be constructed in a first front end section of the cylindrical side wall and the separator surface can be arranged in a second front end section of the cylindrical side wall opposite to the first front end section. By arranging the separator surface on the dust separator as far as possible from the inlet opening for dust-laden air, a wide section inside the dust separator is used for separating the dust from the air. If the dust-laden air is exposed to a separation process over the widest possible section, a maximum degree of separation can be achieved. This has the advantage that the efficiency of the dust separator is very high.

Advantageously the separator surface and the first outlet are arranged substantially oppositely in the first wall. As a result of the substantially opposing arrangement of separator surface and first outlet, the greatest possible separation of fine-dust outlet and coarse-dust outlet is achieved. This prevents undesirable mixing of fine dust and coarse dust from taking place. Such a spatial separation for fine dust and coarse dust outlet improves the separating result.

In one embodiment the separator surface can be constructed as a sieve. The separating grain size is determined by selecting the mesh width of the sieve. Only dust particles having a grain diameter smaller than the separating grain size can pass through the sieve and enter the dust collecting compartment. Dust particles having a diameter larger than the separating grain size are retained by the sieve and remain in the dust-laden air inside the dust separator. As a result of the formation of the separator surface as a sieve, the separating grain size can be exactly predefined by selecting the mesh width of the sieve. This has the advantage that too-coarse particles can be reliably prevented from entering into the dust collecting compartment for fine dust.

Alternatively, the separator surface can be constructed as a gap. When the separator surface is constructed as a gap, the gap width determines the separating grain size. Dust particles having a grain diameter smaller than the gap width can emerge from the dust separator and be used in the dust collecting compartment for fine dust. Dust particles having a diameter larger than the gap width of the gap are returned to the dust separator. The advantage of the separator surface as a gap is that the separator surface can be produced inexpensively as a gap and can be used more flexibly.

The gap is preferably arranged such that it runs substantially perpendicularly to the axial elongation in the side wall of the dust separator. This has the advantage that the separation of the fine dust is concentrated on a narrowly defined section in the axial direction of the dust separator. If the gap is arranged near the upper front end section of the dust separator, the largest possible volume can be used as the dust collecting compartment for fine dust.

In one advantageous embodiment the gap extends radially over 60° to 120°, preferably over about 90° of the circumference in a cylindrical side wall section of the dust separator. In order to obtain adequate separation of fine dust, it is necessary to construct the gap so that it extends at least over 60° of the circumference. If the gap extends more than 120° over the circumference of the cylindrical side wall, no further significant improvement in the separation of fine dust is obtained. Effective separation of fine dust is achieved if the gap extends over about 90° of the circumference in a side wall section of the cylindrical side wall.

The gap can have a gap width of 0.1 to 1 mm, preferably of about 0.3 mm. With regard to usual house dust, a particularly favourable division of dust into fine dust and coarse dust is obtained with this preferred separating grain size of about 0.3 mm. As a result of the favourable choice of ratio of fine dust and coarse dust, the dust collecting capacity of the dust collecting receptacle can be optimally utilised. Emptying the dust collecting receptacle is preferably only necessary when both the dust collecting compartment for fine dust and the dust collecting compartment for coarse dust are approximately full.

It is advantageous if the gap is constructed as an open-edged exposed recess in the side wall of the dust separator. As a result of the construction as an open-edged exposed recess, the gap can be produced using simple tools. This has the advantage that the dust collecting receptacle can be manufactured inexpensively.

The open-edged exposed recess can be delimited by a receptacle cover of the dust separator. This has the consequence that the gap can be opened by opening the receptacle cover of the dust separator. Any particles stuck in the gap can be loosened after opening the receptacle cover and eliminated in a simple fashion.

The first dust collecting compartment can be separated from the second dust collecting compartment by a dividing wall which forms a channel wall of an inlet channel arranged before the inlet opening in the flow direction of the suck-in air. As a result of this arrangement, a dust collecting receptacle having the simplest possible structure is provided. In particular, if the dust collecting receptacle is made of plastic, only a small number of side walls are necessary for the dust collecting compartments and the dust separator. This has the advantage that the dust collecting receptacle can be manufactured using the smallest possible quantity of plastic material.

The dust collecting compartment to receive the coarse dust fraction preferably has a larger volume that the second dust collecting compartment to receive the fine dust fraction. Taking into account the composition of usual house dust, the dust collecting compartment to receive the coarse dust fraction should be constructed as significantly larger than the dust collecting compartment for receiving the fine dust fraction. House dust usually contains a significantly larger fraction of coarse dust particles than fine dust particles.

Figure 1:
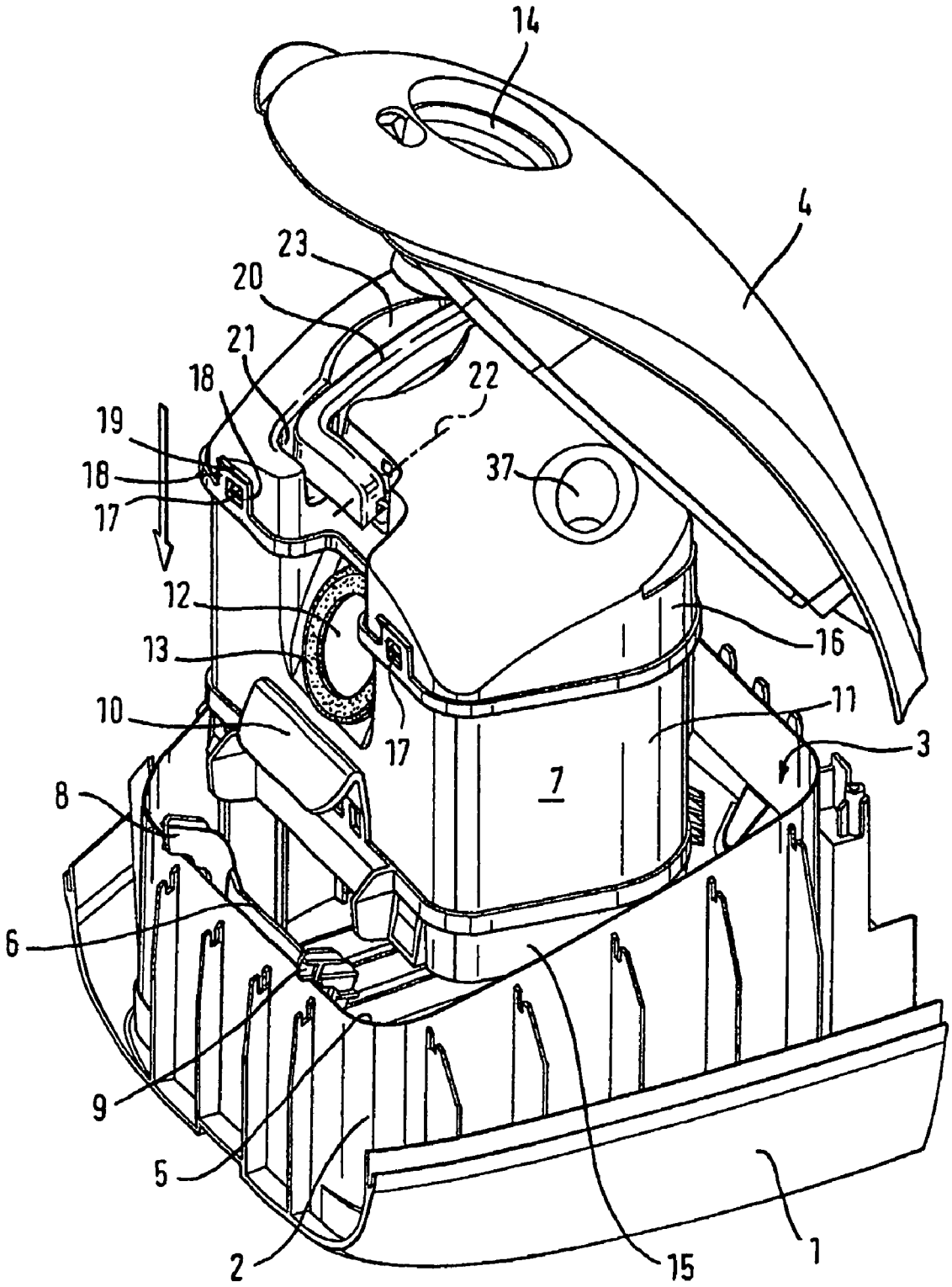
FIG. 1 is a perspective view of a dust compartment of a vacuum cleaner with a dust compartment cover and an inserted dust collecting receptacle according to the invention.

FIG. 1 shows a section from a vacuum cleaner housing 1. A side wall 2 of the vacuum cleaner housing 1 defines a dust compartment 3. The dust compartment 3 is constructed as open at the top and can be closed by a dust compartment lid 4. When closed, the underside of the dust compartment lid 4 abuts against an upper edge 5 of the side wall 2.

Located in the area of the front section of the side wall 2 is a support 6 for receiving a dust collecting receptacle 7. The support 6 has two opposing locking members 8 and 9 which grip over the upper edge 5 of the side wall 2 when the dust collecting receptacle 7 is not inserted and thereby prevent the dust compartment lid 4 from correctly closing the dust compartment 3. In the position shown in FIG. 1 the locking members 8 and 9 are located in a position in which closure of the lid 4 is prevented. When the dust collecting receptacle 7 is inserted correctly in the dust compartment 3, the locking members 8 and 9 are swivelled back inwards into the dust compartment 3 and the upper edge 5 of the side wall 2 is released. The locking members 8 and 9 are swivelled back by an actuating member 10 attached to the dust collecting receptacle 7.

The dust collecting receptacle 7 has a hollow box-like housing portion 11 which is preferably made of transparent plastic. The housing portion 11 is constructed as open at the top and at the bottom. Located in one side wall of the housing portion 11 is a dust inlet 12 via which dust-laden air enters into the interior of the dust collecting receptacle 7. A seal 13 is arranged at the edge of the dust inlet 12. In one operating position of the dust collecting receptacle 7 the dust compartment 3 of the vacuum cleaner is closed by the dust compartment lid 4. The dust compartment lid 4 is interrupted at one point and there has an inlet connection 14 to which a suction hose not shown can be connected. In this closed position of the dust compartment lid 4, the inlet connection 14 abuts against the seal 13 of the dust inlet 12 of the dust collecting receptacle 7 in a sealing fashion.

The housing portion 11 is closed at the bottom by a receptacle bottom 15 and at the top by a receptacle lid 16. The receptacle bottom 15 has the actuating member 10. The receptacle bottom 15 is preferably made of plastic and has an outer framework traverse on which the actuating member 10 is formed. The actuating member is constructed as a hook-shaped lug. The fixed side of the hook-shaped lug is formed on the framework traverse of the receptacle bottom 15 and extends from the receptacle bottom 15 in the direction of the receptacle lid 16. The free side of the hook-shaped lug is bent downwards in the direction of the receptacle bottom.

The receptacle lid 16 is detachably affixed to the housing portion 11. For fixing, locating hooks 17 formed on the receptacle lid 16 engage in lugs 18 of the housing portion 11. Each lug 18 has a tongue 19. If the tongue 19 is moved perpendicularly away from the contact surface of the lug 18 on the container lid 16, the associated locating hook 17 can be released from the lug 18 and the receptacle lid 16 can be separated from the housing portion 11. A handle 20 is fixed on the top of the receptacle lid 16. The handle 20 is accommodated in a recess 21 in the receptacle lid 16 in a space-saving manner. The handle 20 can be pivoted about its axis of rotation 22 from its horizontal storage position into a vertical position in which the dust collecting receptacle 7 can be carried. In order that the handle 20 can pivot easily from the storage position, a handle recess 23 is formed in the receptacle lid 16 at the edge of the recess 21. The handle 20 can be pre-tensioned in the storage position or in the position for carrying by means of a spring which is not shown, which acts about the axis of rotation 22.

Figure 2:
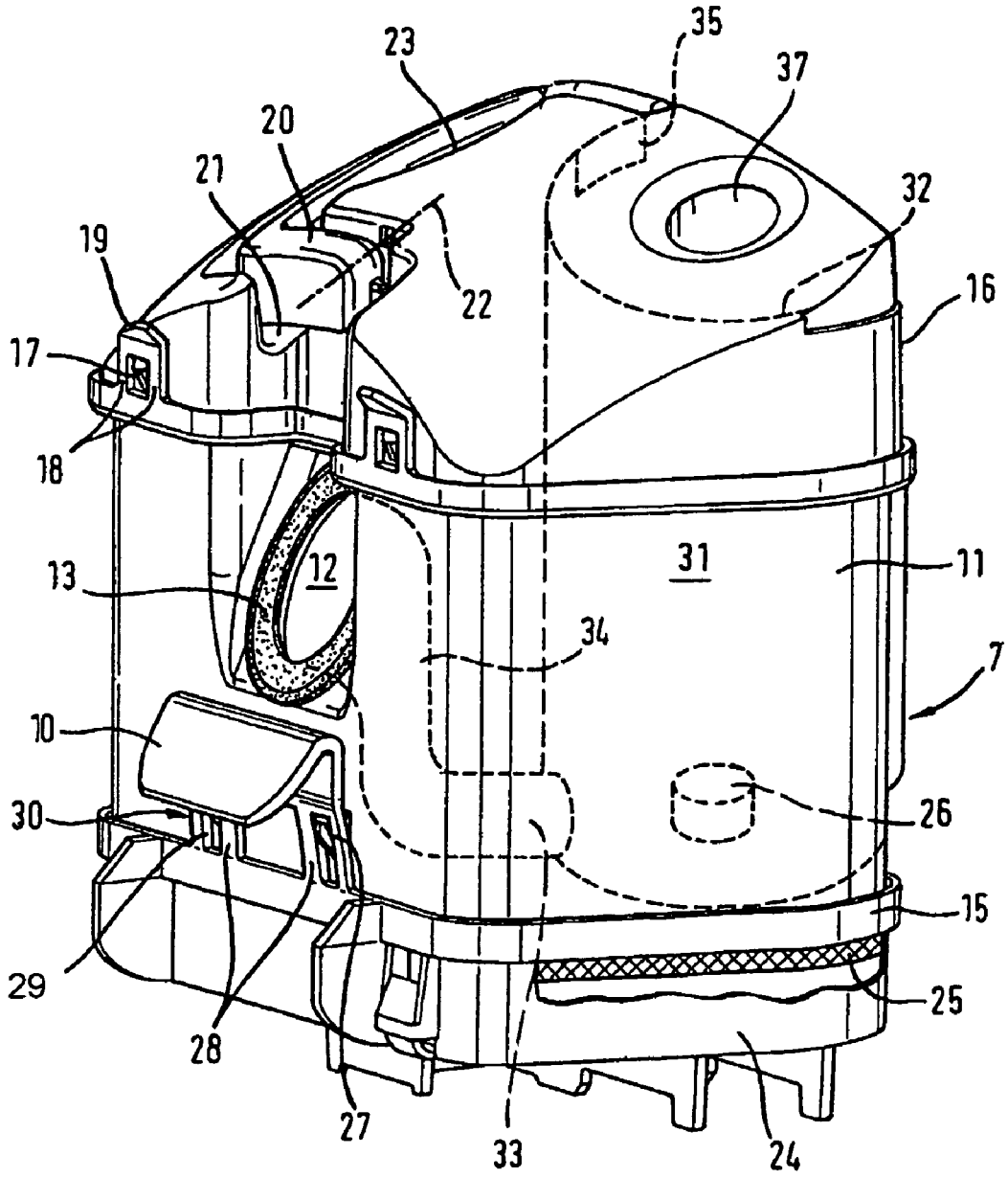
FIG. 2 is a perspective view of the dust collecting receptacle according to FIG. 1.

FIG. 2 shows the dust collecting receptacle 7. The housing portion 11 open at the bottom is closed by the receptacle bottom 15. The receptacle bottom 15 has a filter housing 24 which holds a filter mat 25 which at least completely covers an air outlet opening 26. The air outlet opening 26 can be lengthened in a tubular fashion to form an immersion pipe. The filter mat 25 retains the dust in the dust collecting receptacle 7. The receptacle bottom 15 is pivotally mounted on the housing portion 11 by means of a hinge which is not shown. Locating lugs 27 moulded on the housing portion 11 engage in web sections 28 which comprise recesses 29. The locating lugs 27 and the web sections 28 with the recesses 29 form closure elements 30 for unlocking and locking the receptacle bottom 15 on the housing portion 11.

The dust collecting receptacle 7 contains a dust separator 31 operating on the centrifugal force principle. The dust separator 31 extends in the housing portion 11 from a bottom end which holds the receptacle bottom 15 as far as a lid end which holds the receptacle lid 16. The dust separator 31 has a hollow cylindrical side wall 32. On a bottom end section of the dust separator 31 an inlet opening 33 is provided in the hollow cylindrical side wall 32. The inlet opening 33 is fluid-dynamically connected to the dust inlet 12 via an inlet channel 34.

Figure 3:
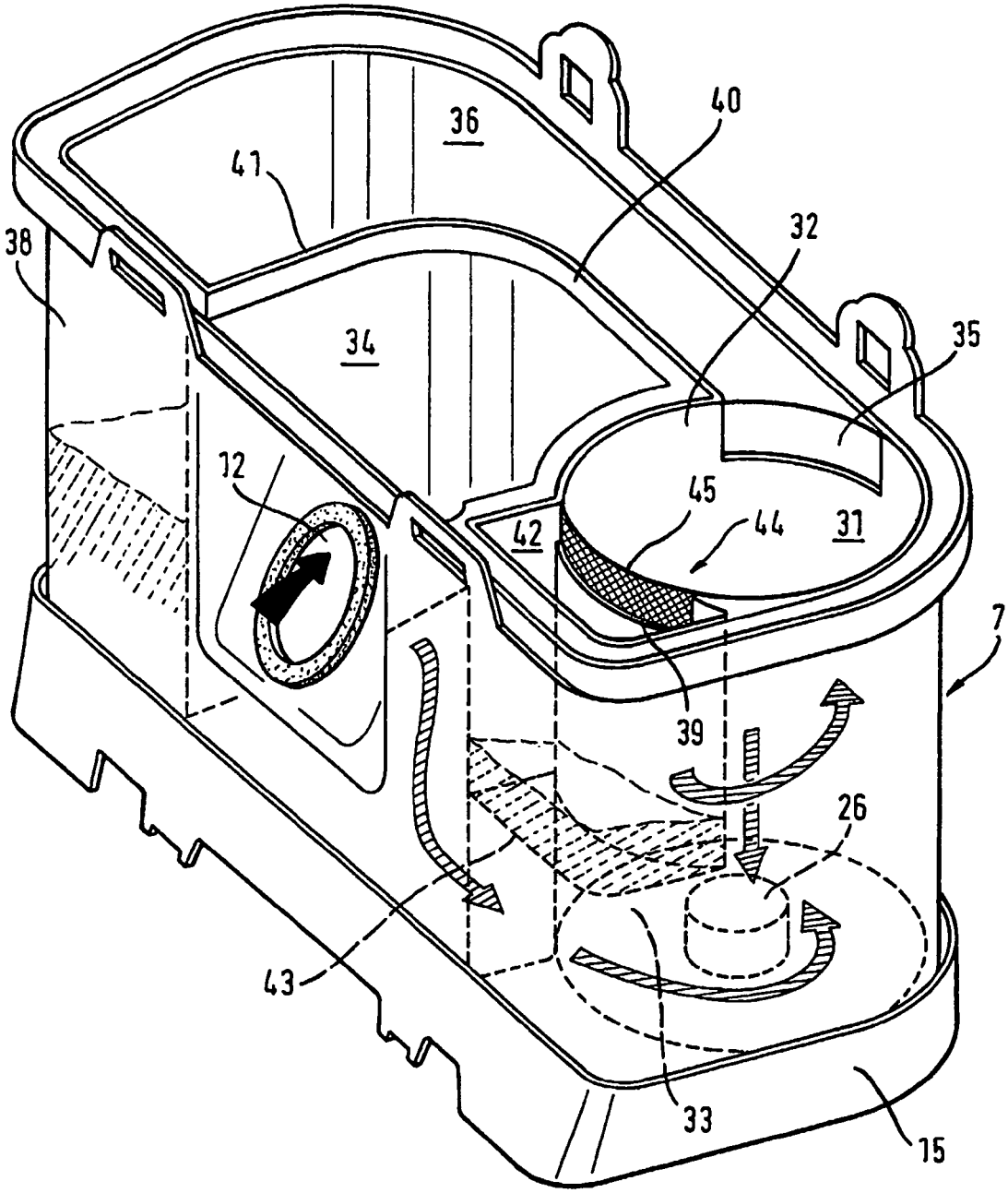
FIG. 3 is a perspective view of the dust collecting receptacle according to FIG. 2 without the receptacle lid, with a separating device constructed as a sieve.

Dust-laden air flows tangentially into the cylindrical dust separator 31 via the inlet channel 34 and the inlet opening 33 (see also FIG. 3). The dust-laden air flows spirally upwards in the direction of the receptacle lid 16. As a result of centrifugal force the dust is concentrated near the wall and is transported upwards as a result of the air flow. The dust is separated into a first dust collecting compartment 36 via a first outlet 35 which is arranged in the upper end area of the dust separator 31 and is constructed as a cut-out in the side wall 32. At the upper face of the dust separator 31 the air freed from dust is deflected downwards in the direction of the receptacle bottom 15 by means of a deflecting element 37 arranged in the receptacle lid 16 coaxially with the cylindrical side wall of the dust separator 31. The air freed from dust leaves the dust separator 31 via an air outlet opening 26 and enters the filter housing 24. Any very fine dust which could not be separated and may still be present, can be retained on the filter mat 25. At the underside of the receptacle bottom 15 the cleaned air leaves the dust collecting receptacle 7.

FIG. 3 shows the dust collecting receptacle 7 with the receptacle lid 16 removed. The housing portion 11 has an outer wall 38 which is closed over the circumference and is open at the top in the direction of the receptacle lid 16 and at the bottom in the direction of the receptacle bottom 15. In the horizontal cross-section of the dust collecting receptacle 7 the outer wall 38 is constructed as substantially rectangular with four rounded corner areas. The side walls of the outer wall 38 are substantially flat. In the corner areas the outer wall 38 is curved. At least in the corner with which the dust separator 31 is associated, the outer wall 38 has a radius of curvature which corresponds to the radius of the cylindrical side wall 32 of the dust separator 31. The side wall 32 is partly formed by the outer wall 38. A cylindrical side wall section 39 which forms a side wall of the second dust collecting compartment 42 constitutes a further portion of the side wall 32. A dividing wall 40 which extends from the receptacle bottom 15 to the receptacle lid 16 is arranged in the dust collecting receptacle 7. The dividing wall 40 substantially serves as the channel wall of the inlet channel 34. The dividing wall 40 is partly formed by a portion of the side wall 32 of the dust separator 31, the side wall 41 of the first dust collecting compartment 36 for coarse dust and the side wall of a second dust collecting compartment 42 for fine material.

The second dust collecting compartment 42 extends from the upper edge of the housing portion 11 to about halfway down. A bottom surface 43 defines the second dust collecting compartment 42 at the bottom. The bottom surface 43 at the same time forms an upper boundary wall for the inlet channel 34 in the dust separator 31. In the outer wall 38 the dust inlet 12 is constructed as a circular cut-out. The inlet channel 34 adjoins the dust inlet 12. Dust-laden air flowing into the inlet channel 34 is guided under the second dust collecting compartment 42 and from there tangentially via the inlet opening 33 (see also FIG. 2) into the dust separator 31. Turbulence directed upwards towards the first outlet 35 is formed in the dust separator 31. The air freed from dust flows downwards at the centre of the turbulence towards the air outlet opening 26. From the air outlet opening 26 the air passes out from the dust collecting receptacle 7.

The coarse dust is expelled into the first dust collecting compartment 36 via the outlet 35 and collects therein. A second outlet 44 somewhat below the outlet 35 and opposite thereto is arranged in the cylindrical side wall section 39 of the dust separator 31. The outlet 44 has a separating device 45 embodied as a separator surface. In the exemplary embodiment the separator surface is shown as a simple sieve. Depending on the mesh width of the sieve 45 only fine dust having a grain diameter of less than the mesh width of the sieve 45 is expelled into the second dust collecting compartment 42 and collects therein. Dust having a grain diameter larger than the mesh width of the sieve 45 is returned into the dust separator 31 and is expelled into the first dust collecting compartment 36 via the outlet 35 as coarse dust.

Figure 4:
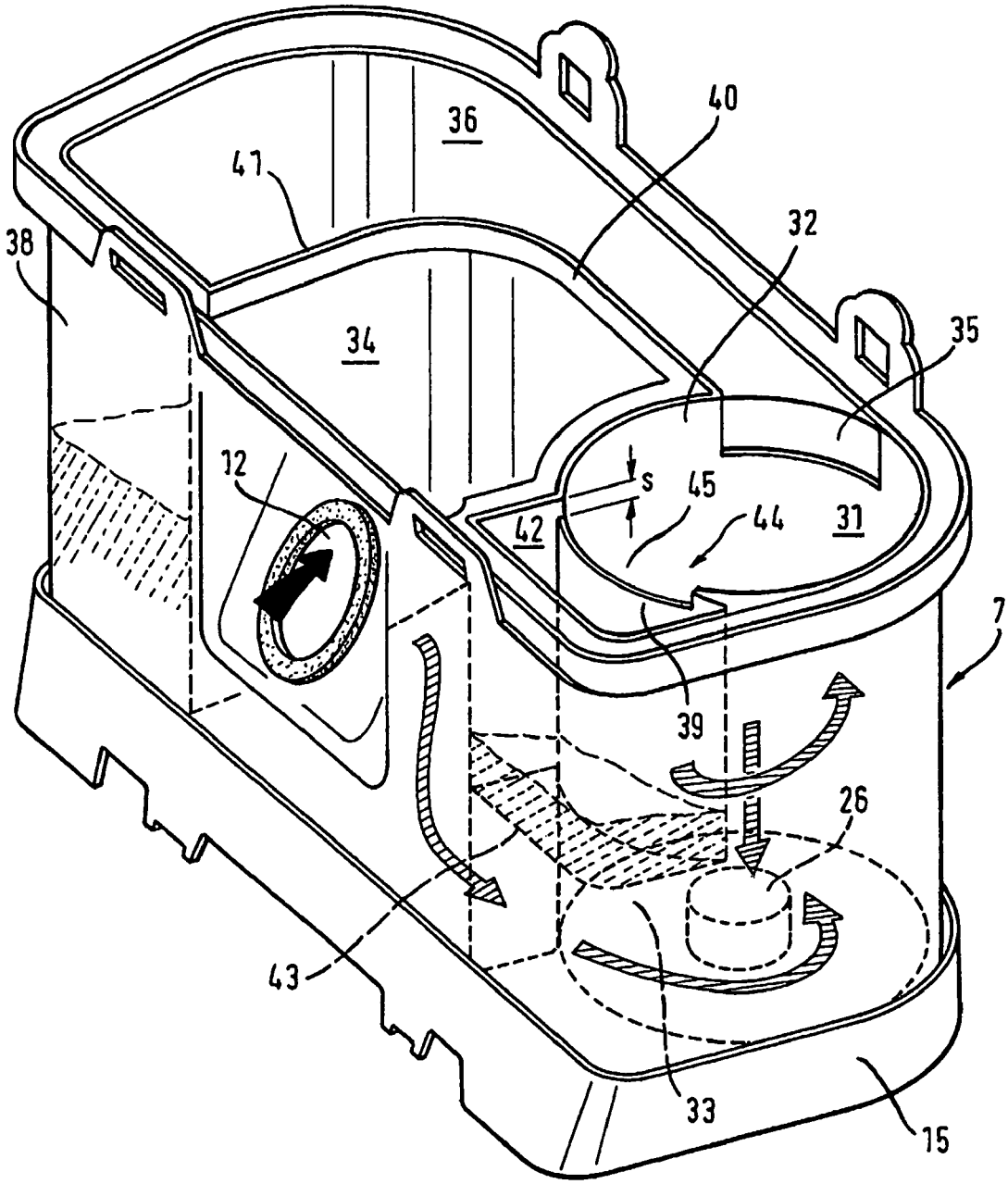
FIG. 4 is a perspective view of the dust collecting receptacle according to FIG. 3 where the separating device is constructed as a gap.

FIG. 4 shows the dust collecting receptacle 7 with largely the same features as shown in FIG. 3. Unlike FIG. 3, the separating device 45 is constructed as a gap not as a sieve. The gap 45 is formed by the second outlet 44 being reduced in height to a gap width (s). The gap 45 runs perpendicularly to the axial extension in the side wall 32 of the dust separator 31, i.e. in the horizontal direction in the position shown and extends radially over about 90° of the circumference in the cylindrical side wall section 39. For illustration the gap 45 is shown with its gap width disproportionately enlarged in FIG. 4. In fact, the gap width s is only between 0.1 and 1 mm, depending on the selected separating grain size for the fine dust to be separated. In the embodiment shown the gap 45 is constructed as an open-edged exposed recess on the upper edge of the cylindrical side wall section 39. When the dust collecting receptacle 7 is in operation, the gap 45 is bordered by the receptacle lid 16 at its open side edge (FIG. 2). The upper edges of the outer wall 38 of the housing portion 11, the side wall 32 of the dust separator 31, the dividing wall 40 and the side wall 41 bear a seal not shown which abuts against the receptacle lid 16 when this closes the dust collecting receptacle 7. The seal separates the individual compartments from outside and from one another in an airtight fashion.

The invention claimed is:

1. A removable dust collecting receptacle, for use in a dust compartment of a vacuum cleaner, comprising:

a dust separator which operates according to the centrifugal force principle and which has an inlet opening for receiving dust-laden air including a first dust fraction and a second dust fraction;

a first outlet for removing the first dust fraction separated from the dust-laden air by the dust separator;

a first dust collecting compartment in fluid flow communication with the first outlet and at least partially collecting the first dust fraction;

a separating device separating the second dust fraction from at least one of the dust-laden air and the first dust fraction; and a second dust collecting compartment at least partially collecting the second dust fraction separated by the separating device.

2. The dust collecting receptacle according to claim 1, wherein the separating device is constructed to separate the second dust fraction from the dust-laden air.

3. The dust collecting receptacle according to claim 1, wherein the separating device is constructed to separate the second dust fraction from the first dust fraction.

4. The dust collecting receptacle according to claim 1, wherein the dust collecting receptacle has a second outlet for removing the second dust fraction separated by the separating device into the second dust collecting compartment, the second dust collecting compartment being in fluid flow communication with the second outlet.

5. The dust collecting receptacle according to claim 1, wherein the separating device is arranged between the dust separator and at least one of the first dust collecting compartment and the second dust collecting compartment.

6. The dust collecting receptacle according to claim 5, wherein the dust separator includes a cylindrical side wall having an opening and the separating device includes a separator surface arranged in the opening of the side wall.

7. The dust collecting receptacle according to claim 6, wherein the separator surface in the cylindrical side wall is downstream of the inlet opening and upstream of the first outlet in the direction of flow of the dust-laden air.

8. The dust collecting receptacle according to claim 7, wherein the inlet opening for dust-laden air is constructed in a first front end section of the cylindrical side wall and the separator surface is arranged in a second front end section of the cylindrical side wall opposite to the first front end section.

9. The dust collecting receptacle according to claim 6, wherein the separator surface and the first outlet are arranged substantially oppositely in the side wall.

10. The dust collecting receptacle according to claim 6, wherein the separator surface includes a sieve.

11. The dust collecting receptacle according to claim 6, wherein the separator surface defines a gap arranged so that it runs substantially perpendicular to the axial extension in the side wall.

12. The dust collecting receptacle according to claim 11, wherein the separator surface (45) includes a gap extending radially between 60 to 120 degrees of the circumference in a side wall section of the cylindrical side wall.

13. The dust collecting receptacle according to claim 12, wherein the gap extends radially about 90 degrees of the circumference in the side wall section of the cylindrical side wall.

14. The dust collecting receptacle according to claim 11, wherein the gap has a gap width between 0.1 and 1.0 mm.

15. The dust collecting receptacle according to claim 14, wherein the gap width is about 0.3 mm.

16. The dust collecting receptacle according to claim 11, wherein the gap is embodied as an open-edged exposed recess in the side wall.

17. The dust collecting receptacle according to claim 16, wherein the open-edged exposed recess is delimited by a receptacle lid of the dust separator.

18. The dust collecting receptacle according to claim 1, wherein the first dust collecting compartment is separated from the second dust collecting compartment by a dividing wall which forms a channel wall of an entrance channel arranged before the inlet opening in the direction of flow of the dust-laden air.

19. The dust collecting receptacle according to claim 1, wherein the first dust collecting compartment for receiving the first dust fraction has a larger volume that the second dust collecting compartment for receiving the second dust fraction.

20. The removable dust collecting receptacle as claimed in claim 1, wherein the separating device is positioned upstream of the first and/or second dust collecting departments.

21. The removable dust collecting receptacle as claimed in claim 1, further comprising a second outlet for removing the second dust fraction separated by the separating device into the second dust collecting compartment, and wherein the first and second outlets are positioned on an upper end of the dust separator.

22. The removable dust collecting receptacle as claimed in claim 1, wherein the first and second dust fractions to be collected in the first and second dust collecting compartments, respectively, have different characteristics.

23. The removable dust collecting receptacle as claimed in claim 22, wherein the first dust fraction to be collected in the first dust collecting compartment includes coarse dust and the second dust fraction to be collected in the second dust compartment includes only fine dust.

24. The removable dust collecting receptacle as claimed in claim 1, wherein the separating device is positioned between the dust separator and the second dust collecting department.

25. The removable dust collecting receptacle as claimed in claim 1, further comprising a filter positioned at an outlet opening of the dust separator, the second dust fraction in use being collected in the second dust collecting compartment before reaching the filter.

26. A vacuum cleaner comprising:

a housing defining a dust compartment a dust collecting receptacle removably disposed within the dust compartment and having a dust separator centrifugally separating dust fractions from dust-laden air, the dust separator including:

a side wall forming a substantially cylindrical chamber;

an inlet opening at least partially defined by the side wall and receiving dust-laden air including a first dust fraction and a second dust fraction into the dust separator;

a first outlet at least partially defined by the side wall and receiving the first dust fraction separated from the dust-laden air by the dust separator;

a first dust collecting compartment in fluid flow communication with the first outlet and at least partially collecting the first dust fraction;

a second outlet at least partially defined by the side wall and receiving the second dust fraction; and a second dust collecting compartment in fluid flow communication with the second outlet and at least partially collecting the second dust fraction.

27. The vacuum cleaner according to claim 26, wherein dust particles of the first dust fraction are relatively larger than the dust particles of the second dust fraction.

28. The vacuum cleaner according to claim 26, wherein the side wall extends between a bottom end section and a top end section disposed opposite the first end section, the inlet opening being disposed adjacent the bottom end section and the first and second outlets being disposed adjacent the top end section above the inlet opening.

29. The vacuum cleaner according to claim 26, wherein the first outlet and the second are arranged substantially opposite one another with respect to the circumference of the side wall.

30. The vacuum cleaner according to claim 26, further comprising a sieve disposed within the second outlet and having a mesh structure defining multiple apertures of a selected size to restrict the size of dust particles passing through the second outlet and into the second dust collecting compartment.

31. The vacuum cleaner according to claim 26, wherein the second outlet includes a gap having a gap length extending radially between 60 to 120 degrees with respect to the circumference of the side wall and a gap width between 0.1 and 1.0 mm along the side wall with respect to an axial direction of the cylindrical chamber, the gap restricting the size of dust particles passing through the second outlet and into the second dust collecting compartment.

32. The vacuum cleaner according to claim 31, wherein the gap length extends radially about 90 degrees with respect to the circumference of the side wall and the gap width is about 0.3 mm.

33. The vacuum cleaner according to claim 26, wherein the dust collecting receptacle includes a removable receptacle lid engaging the side wall and at least partially defining the first outlet and the second outlet.

34. The vacuum cleaner according to claim 33, wherein the receptacle lid includes a deflecting element projecting from the receptacle lid toward the dust separator and directing air flow downwardly.

35. The vacuum cleaner according to claim 26, wherein the dust collecting receptacle includes a receptacle bottom having an outlet opening in fluid flow communication with the dust separator and receiving discharge air flow from the dust separator, the receptacle bottom having a filter for restricting remaining dust particles from passing through the outlet opening.

* * * * *